US006948293B1

(12) United States Patent
Eckermann et al.

(10) Patent No.: US 6,948,293 B1
(45) Date of Patent: Sep. 27, 2005

(54) PROCESS FOR PACKAGING CONTAINERS IN SHIPPING CARTONS

(75) Inventors: Jens Eckermann, Bremen (DE); Lambert Brinks, Bolsward (NL); Bernard Skolik, Bassum-Bramstedt (DE)

(73) Assignee: A & R Carton GmbH, Kriftel (DE)

( * ) Notice: Subject to any disclaimer, the term of this patent is extended or adjusted under 35 U.S.C. 154(b) by 0 days.

(21) Appl. No.: 09/403,131

(22) PCT Filed: Apr. 9, 1998

(86) PCT No.: PCT/EP98/02097

§ 371 (c)(1),
(2), (4) Date: Feb. 19, 2000

(87) PCT Pub. No.: WO98/46496

PCT Pub. Date: Oct. 22, 1998

(30) Foreign Application Priority Data

Apr. 16, 1997 (DE) ..... 197 15 750

(51) Int. Cl.[7] ..... B65B 1/04

(52) U.S. Cl. ..... 53/246; 53/48.1; 53/49; 53/266.1; 53/376.4; 53/458; 493/90; 493/91

(58) Field of Search ..... 53/246, 458, 476, 53/48.1, 49, 266.1, 376.3, 376.4, 376.5; 493/90, 493/91, 92, 93

(56) References Cited

U.S. PATENT DOCUMENTS 2,033,526 A * 3/1936 Kenkenon ..... 229/162.7
2,554,190 A * 5/1951 Hennessey ..... 206/429
2,706,935 A 4/1955 Pasjack ..... 93/37
4,055,943 A * 11/1977 Reichert ..... 53/247
4,160,353 A * 7/1979 Ganz ..... 53/393
4,177,715 A * 12/1979 Meyers ..... 493/59
4,310,323 A * 1/1982 Moen ..... 493/92
4,332,123 A * 6/1982 Calvert ..... 53/475
4,505,696 A * 3/1985 Wright et al. ..... 493/130
5,826,783 A * 10/1998 Stout ..... 229/120.32

FOREIGN PATENT DOCUMENTS

| | | |
|---|---|---|
| DE | 1 157 463 | 11/1963 |
| DE | 1 931 611 | 2/1970 |
| DE | 2 349 458 | 4/1974 |
| DE | 2 427 919 A1 | 12/1975 |
| EP | 0 280 095 | 2/1988 |
| EP | 0 561 737 | 2/1993 |
| FR | 2 681 836 A1 | 9/1991 |
| GB | 2 055 350 | 3/1981 |

* cited by examiner

*Primary Examiner*—Rinaldi I. Rada
*Assistant Examiner*—Christopher Harmon
(74) *Attorney, Agent, or Firm*—Vidas, Arrett & Steinkraus, P.A.

(57) ABSTRACT

A method for packing containers, in particular bottles, in transport boxes in which on the inside, on flat-lying transport boxes, flat-lying multi-piece packagings are releasably fastened or compartment units are fastened, the transport boxes and the multi-piece packagings or compartment units contained therein are set up, containers are applied through openings of the set-up transport boxes into receivers of the multi-piece packages or compartment units, and the openings of the transport boxes are closed.

13 Claims, 7 Drawing Sheets

Figure 1C:
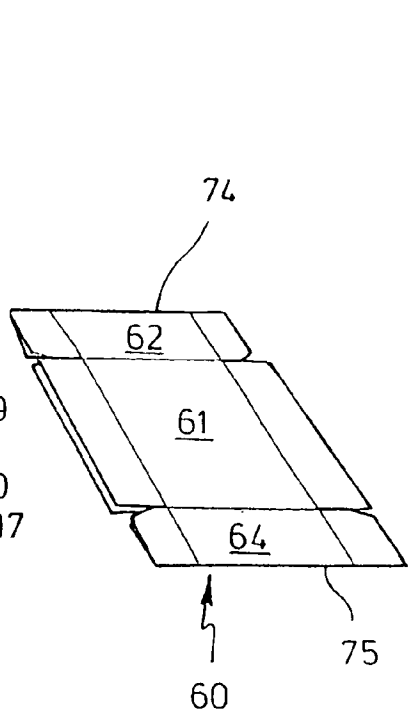

15
10
11
17
58
59
65
66
67
68
69
70
71
72
73
74
75
76
60
61
62
63
64

PROCESS FOR PACKAGING CONTAINERS IN SHIPPING CARTONS

The invention relates to a method for packing containers, in particular bottles, in transport boxes.

For years typical export packagings for beer and other drinks in bottles, in particular for export to North America are known in two traditional versions. For the drinks operation at the retailers the packaging is composed of a transport box and four six-multipiece packagings in the style of the "open basket carrier" (i.e. packagings in the form of a carrier basket open at the top—cf. EP 0 280 095 B1). Drinks bottles for the restaurant business for transport are brought in a conversion box with a separate compartment unit of cardboard or corrugated cardboard.

The transport box for six-multipiece packagings is as a rule manufactured of corrugated cardboard, in exceptional cases also from solid cardboard with a gram weight of more than 800 g/m$^2$. This transport box is pre-adhesed, in the flat condition delivered to the drinks industry and here in the filling region is set up by machine and adhesed in the base region.

Parallel to this pre-adhesed flat-lying "open basket carriers" such as the type "Euroset-Truckloader" (cf. EP 0 280 095 B1) are folded open and interlocked. The set-up "open basket-carriers" interlocked at the base are then in a group of four applied into the already set-up and adhesed transport box. In the further course of the packaging procedure in each case 24 filled bottles with a bottle or placing packer are applied from above into the pre-prepared packaging unit. Subsequently to this filling procedure the transport boxes are closed and paletted ready for transport.

Bottles which are exported for the requirements of the restaurant business for transport come into a enveloping box with compartment units. These transport boxes as described above are set up, adhesed in the base region and in a subsequent procedure in a separate machine installation are equipped with compartment units which with a so-called compartment unit inserter are folded up from a flat condition and from above are incorporated into the transport box. The filling of the resulting packing unit with 24 filled bottles is then in turn effected as described above, and the obtained total unit is then in a similar manner made ready for transport.

Furthermore there are known packing methods which have the following course:

Open basket carriers are folded up, adhesed on the base and four of these six-packs in the set up and empty condition are brought together to a formation. Into this foursome formation the bottles are lowered. The filled foursome formation is then laterally inserted in an enveloping box which is set up parallel to this procedure and which then for transport is closed. The transport box may also be a so-called wrap-around solution which is wound around the formation.

For the transport of loose bottles, 24 bottles are grouped, a web insert is folded out and then drawn over the bottles. In a vibration path the web is shaken between the bodies of the bottles, then the twenty-four unit is laterally inserted into the transport box or wrapped around by a transport box blank.

Proceeding from this it is the object of the invention to simplify the packing procedure in the filling operation of the drinks manufacturer or packers of containers.

This object is achieved by a method for packing containers, in particular bottles, in transport boxes in which on the inside, on flat-lying transport boxes, flat-lying multi-piece packagings are releasably fastened or compartment units are fastened, the transport boxes and the multi-piece packagings contained therein or compartment units are set up, containers are applied through openings of the set-up transport boxes into receivers of the multi-piece packages or compartment units, and the openings of the transport boxes are closed.

According to the invention the transport boxes may already be equipped with multi-piece packagings or compartment units at the packing manufacturer. At the packer then in one working procedure the transport boxes and the multi-piece packagings contained therein may be set up. The separate setting up of the multi-piece packagings or compartment units and their insertion into the transport boxes is done away with.

Preferably the walls of the transport boxes on setting up exert forces onto inner-lying walls of the multi-piece packagings or onto end regions of the compartment units, by which means the multi-piece packagings or compartment units are set up. For setting up the complete packing units then from the outside one only needs to manipulate the transport boxes.

The fastenings serve the retention of the transport boxes and multi-piece packagings or compartment units at least up to the setting up and on setting up may support the force transmission. They are effected preferably by adhesing.

For a simplified removal, multi-piece packagings may be releasably fastened in a position which with respect to their final position in the closed transport boxes, by insertion of the containers the fastenings released and the multi-piece packagings moved into their final position in the transport boxes. On removal of the multi-piece packagings from the transport boxes the fastenings then no longer need be released. If the multi-piece packagings are releasably fastened on lid flaps of the transport boxes hindrances in the removal by remains of the fastenings may be avoided. Preferably the multi-piece packagings are fastened by way of separable cardboard tabs.

The multi-piece packagings may however also be fastened on wall sections which can be torn out and which are bordered by perforation lines. Preferably the wall sections which may be torn out are located in the base walls of the multi-piece packagings and are releasably fastened on base flaps of the transport box. The wall sections which may be torn out may be arranged in the manner of centre sleeve punch-outs on the middle axes of the base walls. On removing the multi-piece packagings from the transport box the wall sections are ripped out and remain in the transport box, wherein on forming on the base walls after the tearing out they do not hinder the removal and do not disturb the aesthetics of the multi-piece packaging.

The same packing installation may be used for the packing of containers in transport boxes with multi-piece packagings as well as in transport boxes with compartment units. This brings considerable space advantages in the filling operation and reduces the susceptibility to breakdown by way of the reduction of the process steps.

Figure 1B:
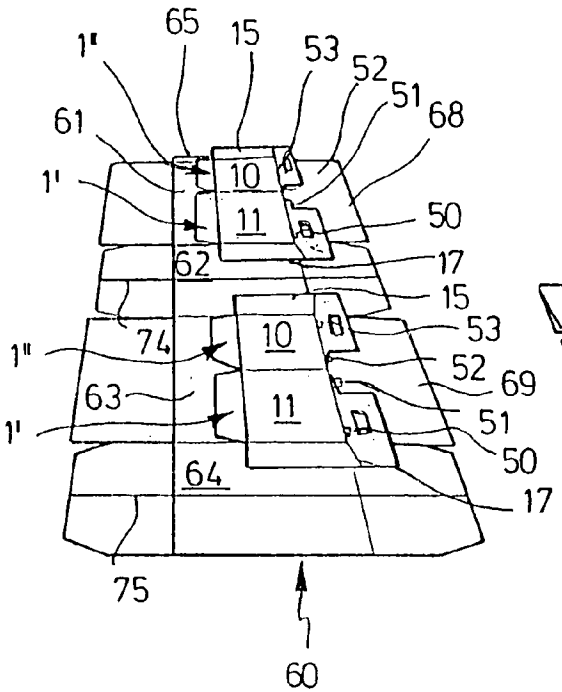
Figure 1A:
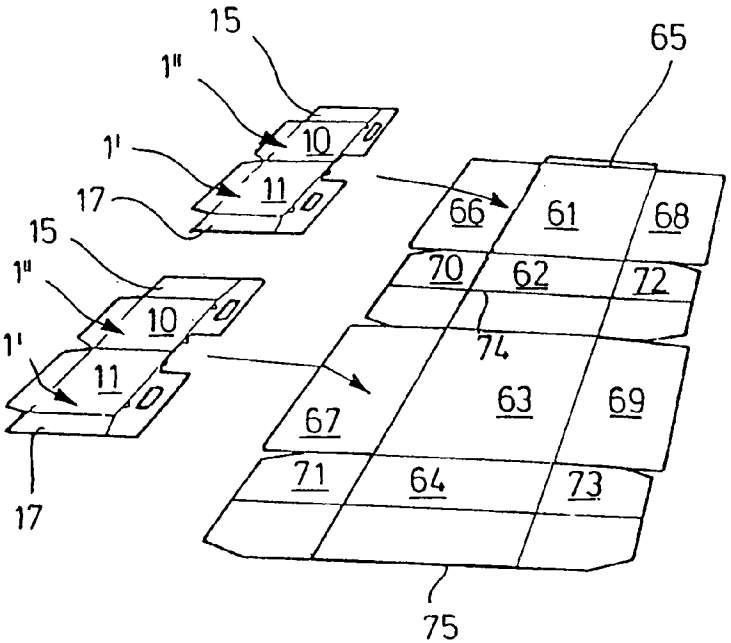
Figure 2C:
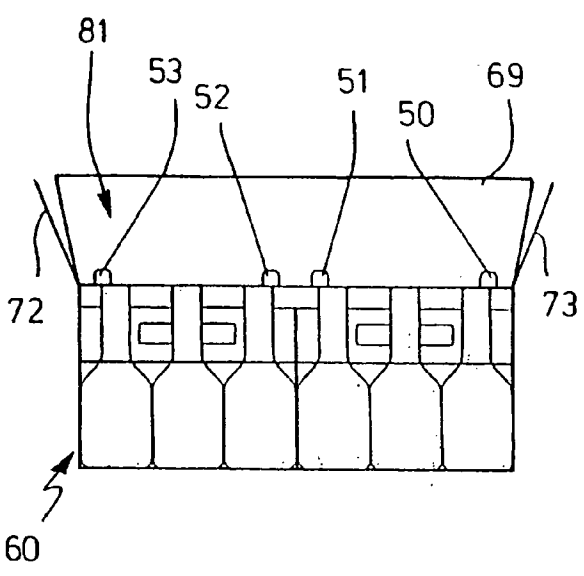
Figure 2B:
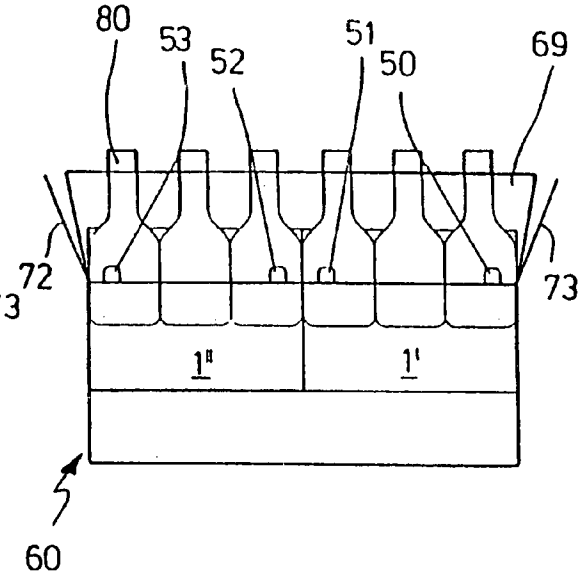
Figure 2A:
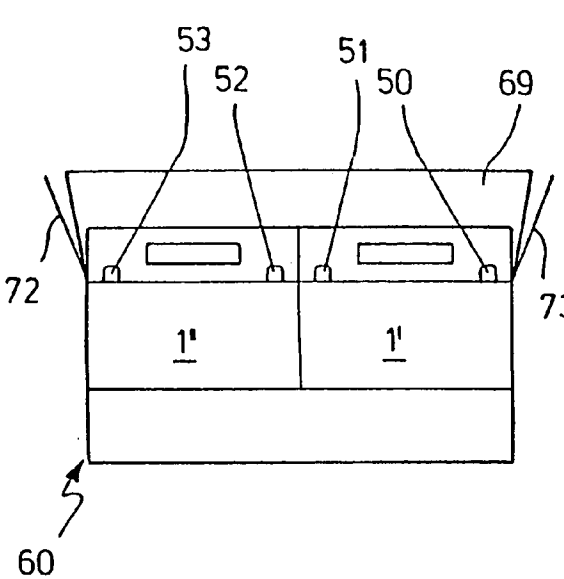
Figure 3:
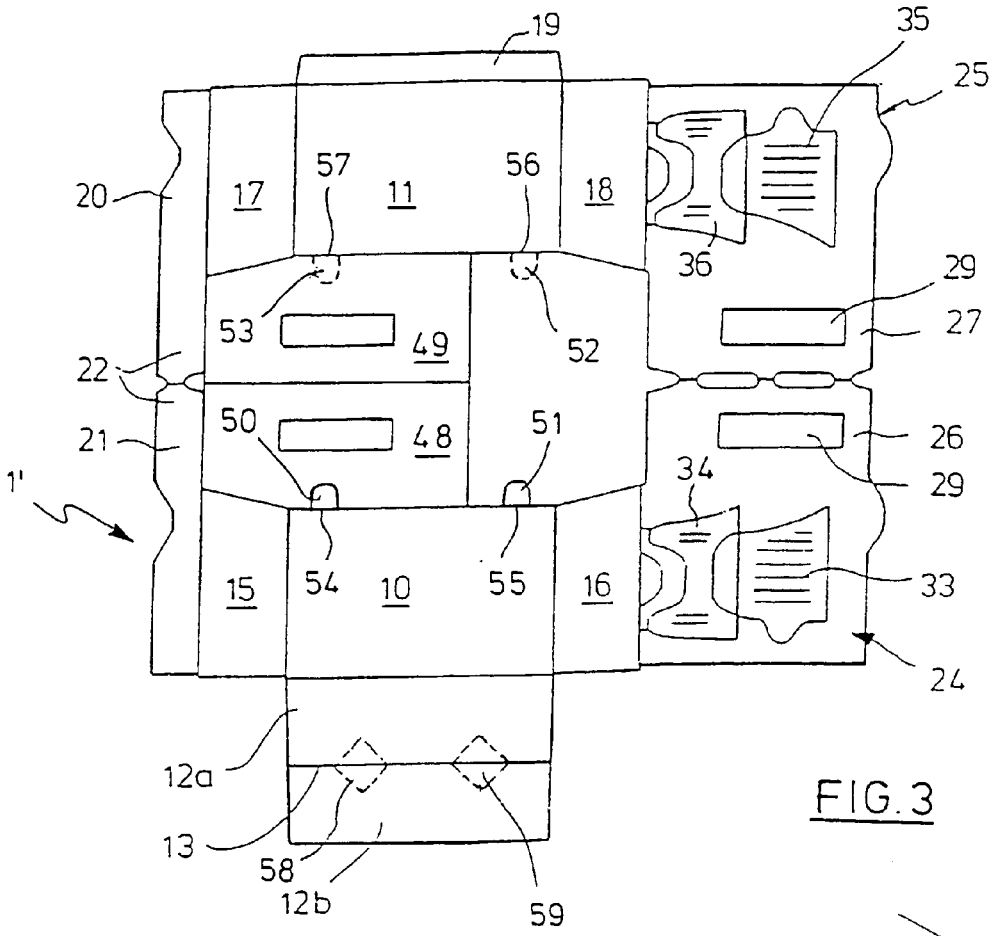
Figure 4:
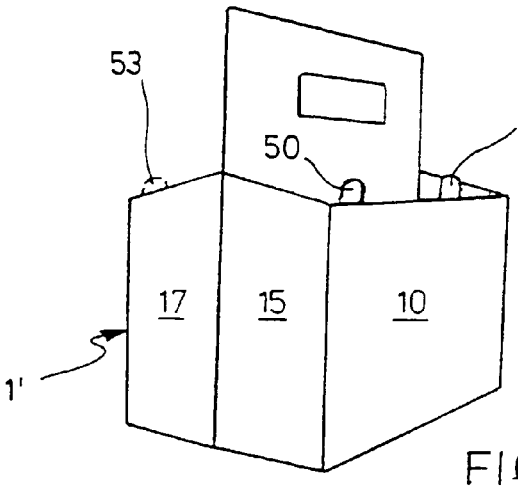
Figure 5:
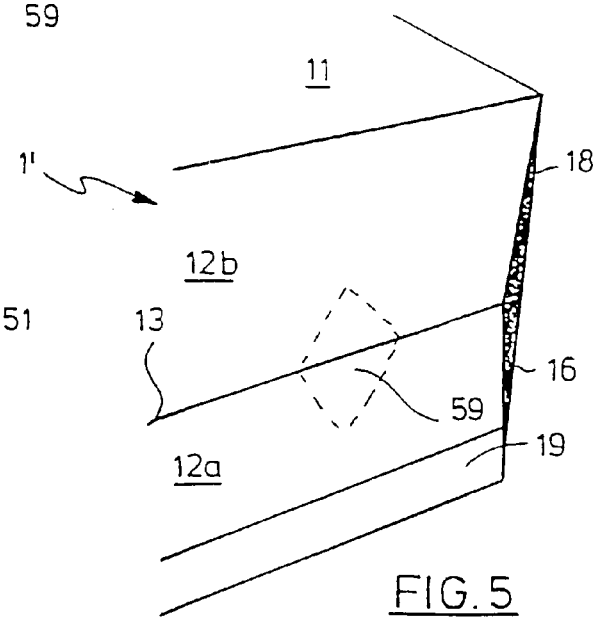
Figures 6A, 6B, 6C:
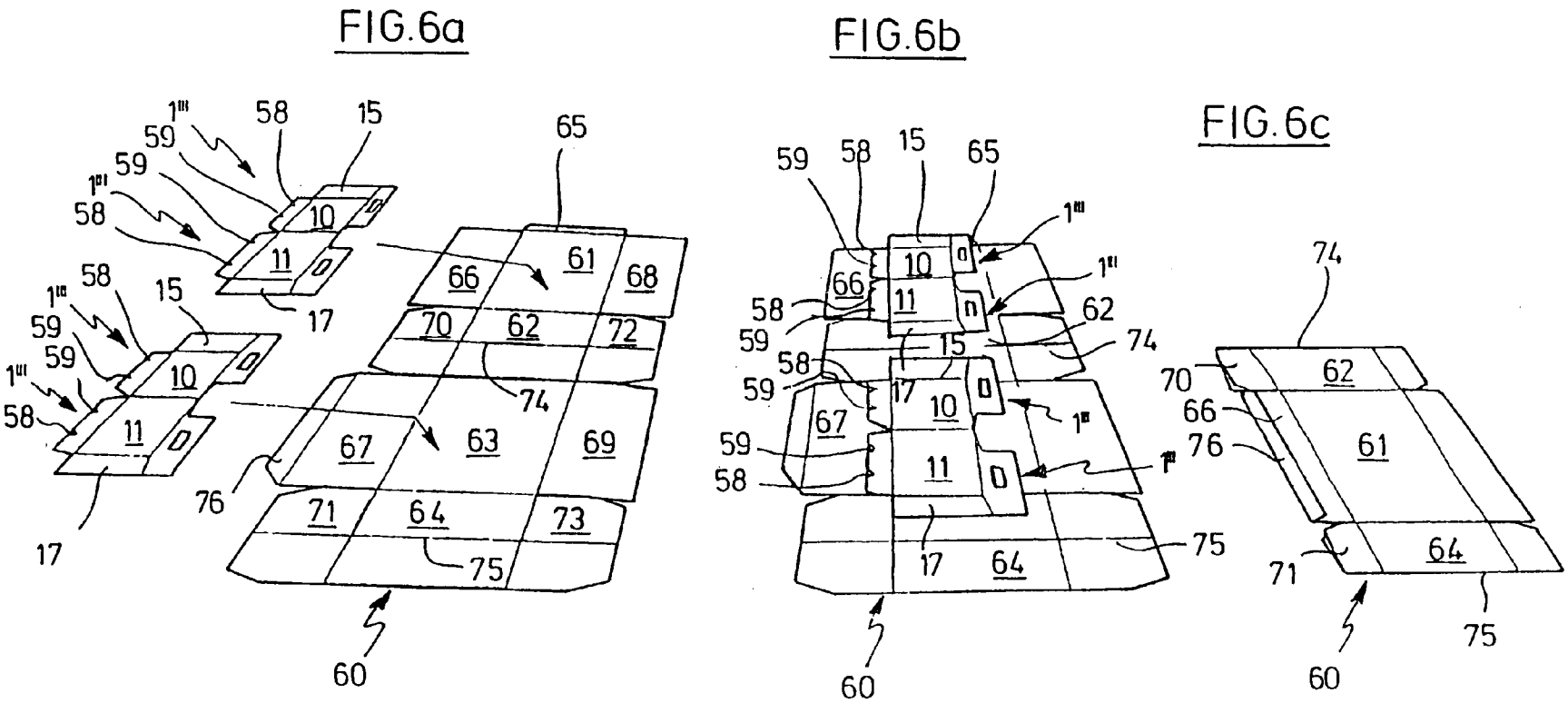
Figure 7:
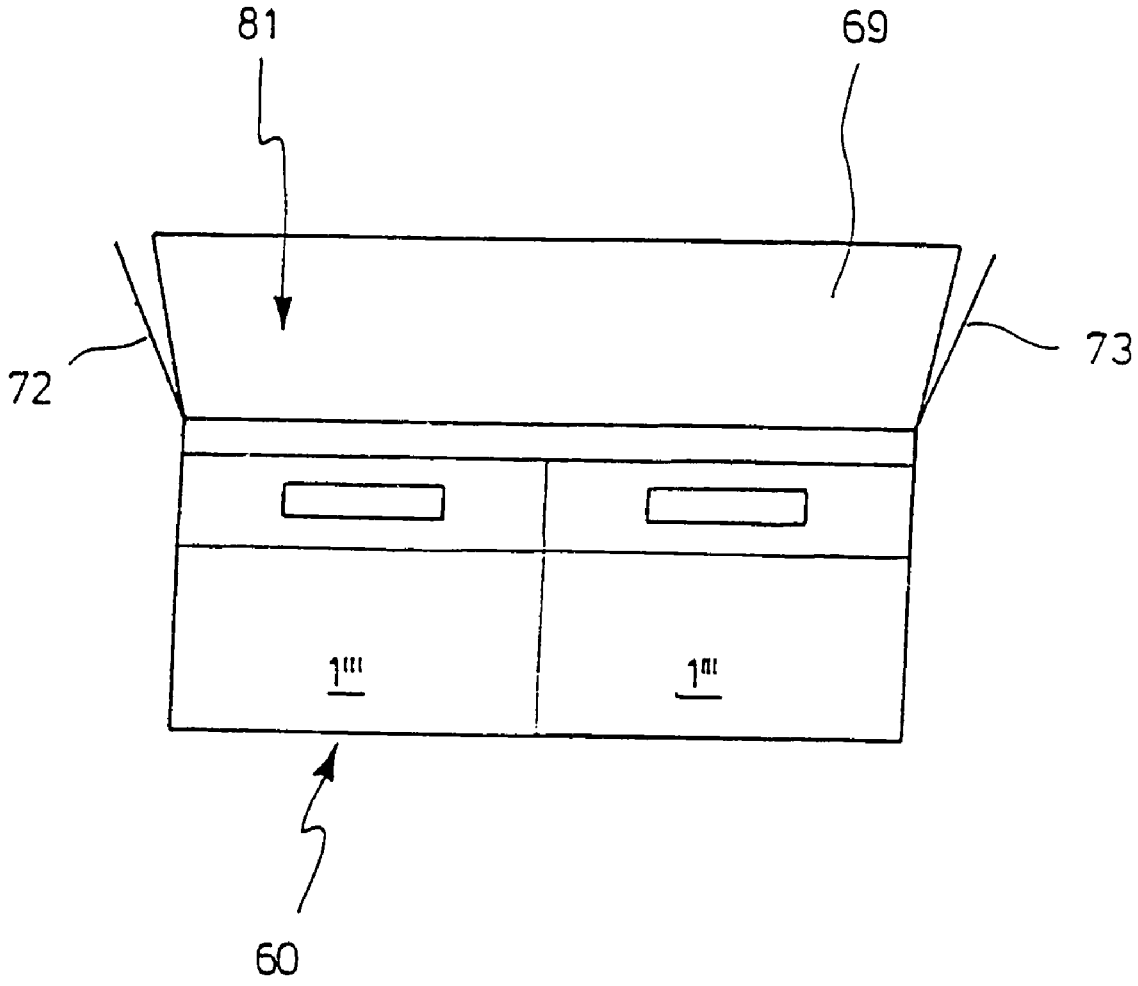
Figure 8A:
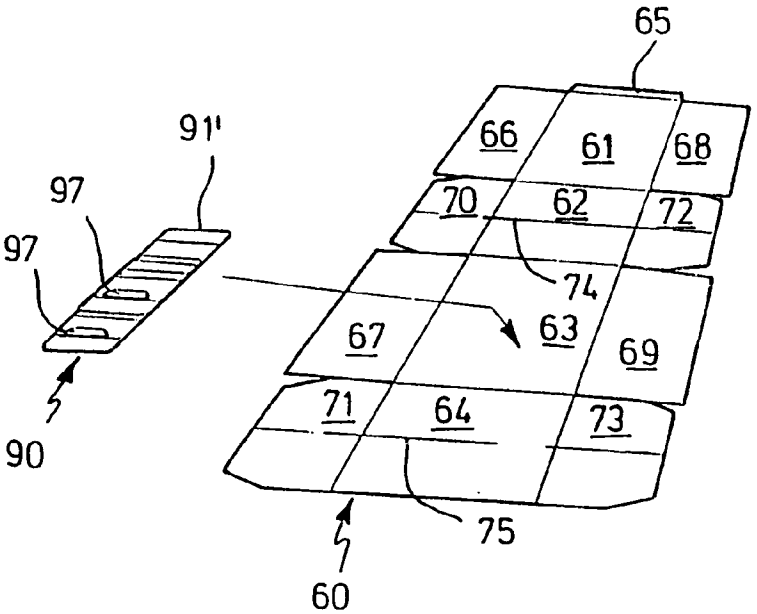
Figure 8B:
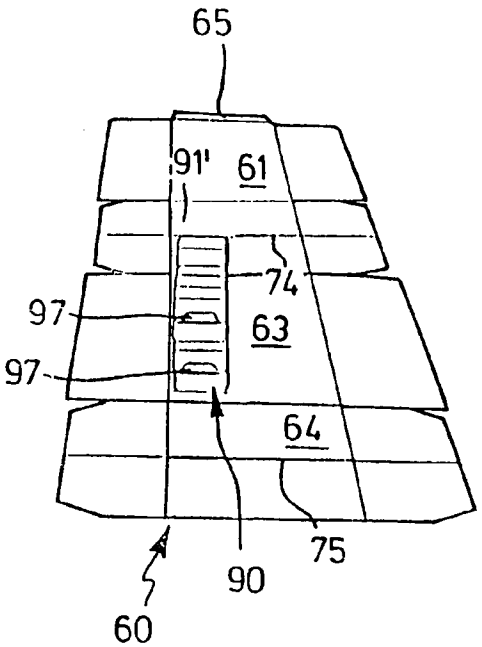
Figure 8C:
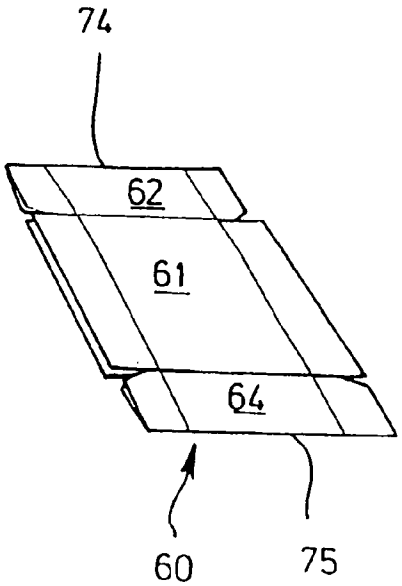
Figure 9:
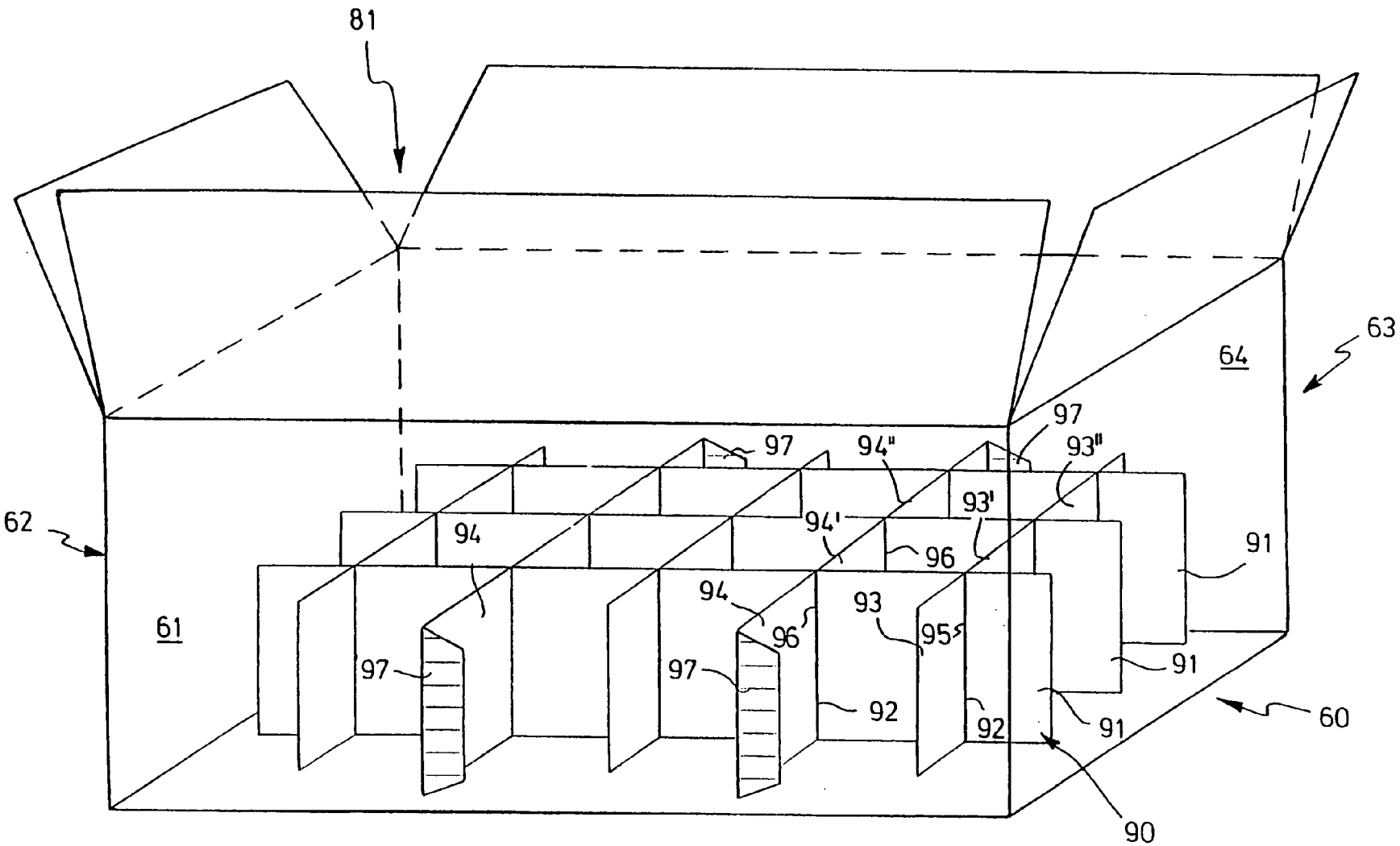

The invention is hereinafter described in more detail by way of the accompanying drawings of practical embodiment forms. In the drawings there are shown:

FIG. 1*a* to *c* a flatly widened-out blank of a transport box with flat-lying multi-piece packagings before the fastening (FIG. 1*a*) and after the fastening (FIG. 1*b*), and the transport box which afterwards is closed to a flat-lying envelope (FIG. 1*c*), in each case in a perspective view obliquely from above;

FIG. 2*a* to *c* the same transport box after setting up (FIG. 2*a*), on inserting bottles (FIG. 2*b*), in each case in a longitudinal section;

FIG. 3 a flatly widened-out blank of the previously mentioned multi-piece packaging in a plan view;

FIG. 4 the multi-piece packaging set up from the blank according to FIG. 3, in a lateral perspective view;

FIG. 5 a part of the multi-piece packaging according to FIG. 4 in a perspective view from below;

FIG. 6*a* to *c* a flatly broadened out blank of another transport box with flat-lying multi-piece packagings before the fastening (FIG. 6*a*) and after the fastening (FIG. 6*b*) and the transport box which subsequently is closed to a flat-lying envelope (FIG. 6*c*) in each case in a perspective view obliquely from above;

FIG. 7 the same transport box after setting up, in a longitudinal section;

FIGS. 8*a* to *c* a flatly broadened out blank of a transport box and a flat-lying compartment unit before the fastening (FIG. 8*a*) and after the fastening (FIG. 8*b*) and the transport box which subsequently is closed to a flat-lying envelope (FIG. 8*c*) in each case in a perspective view obliquely from above;

FIG. 9 the same transport box after setting up, in a heavily enlarged, perspective lateral view.

Firstly by way of FIGS. 3 to 5 the multi-piece packaging of the type "open basket carrier" is explained. The blank 1' shown in FIG. 3 comprises two longitudinal side walls 10, 11. On the outer side of the longitudinal side wall 10 there is hinged a base wall 12. The base wall 12 is subdivided by a score line 13 into two sections 12*a* and 12*b*.

On the oppositely lying sides of the longitudinal side wall 10 there are linked end-face side wall halves 15, 16 via a score line. On the opposite sides of the longitudinal side wall 11 there are hinged end-face side wall halves 17, 18 via score lines. On the outer side of the longitudinal side wall 11 there is hinged a base connecting tab 19. On the end-face side wall halves 15, 17 connecting tabs 20, 21 are hinged via score lines. These tabs are connected to one another via a connection section 22 which in the middle is divided by a score line.

On the end-face side wall halves 16, 18 via score lines there are hinged longitudinal web sections 24, 25. The longitudinal web sections 24, 25 comprise grip sections 26, 27 with grip holes 28, 29.

In the longitudinal web sections 24, 25 in each case two transverse webs 33, 34 and 35, 36 are punched out. Their shaping and their position are not to be described further in detail since they are known per se. Moreover grip sections 48, 49 are hinged on the connection section 22 which in the set up condition coincide with the grip sections 26, 27.

This blank 1' may already be adhesed at the packing manufacturer. For this firstly the longitudinal web sections 24, 25 may be folded with the appended end-face side walls 16, 18 against the longitudinal side walls 10, 11, wherein the grip sections 26, 27 come to bear on the inner sides of the grip sections 48, 49 and are adhesed to these. At the same time the transverse webs 33 to 36 with their tab ends come to bear on the longitudinal side walls 10, 11 and here are adhesed to these. Subsequently the connecting tabs 20, 21 may be folded against the inner sides of the end-face side walls 15, 17 and the grip sections 48, 49 and on the connection section 22 adhesed to the grip sections. Thereafter the parts of the blank about the fold lines in the connection section 22 and between the grip sections 26, 27, 48, 49 are folded against one another wherein an adhesing between the connecting tabs 20, 21 and the longitudinal web sections 24, 25 is effected. Then still the base wall 12 may be folded about the score line 13 and adhesed to the base connecting tab 19. The multi-piece packaging 1' is located in the flat-lying condition, in which it is shown in FIG. 1.

The flat-lying multi-piece packaging 1' may be set up according to FIGS. 4 and 5 in that one presses against the end-face walls 15, 17 and the longitudinal side walls are firmly held. With this the base wall 12 is automatically folded apart.

Further details of the multi-piece packaging 1' may be deduced from EP 0 280 095 B 1. The multi-piece packaging described here has a base interlocking which above all serves the stabilizing in the unfilled condition and which with the multi-piece packaging 1' according to the invention has been left out since this directly after setting up can be filled with bottles and then is sufficiently stable. Beyond the embodiments according to EP 0 280 095 B1 that shown here has either on the longitudinal side wall 10 upwardly projecting, semi-circular cardboard tabs 50, 51 (first variant 1') or on the longitudinal side wall 11 corresponding cardboard tabs 52, 53 (second variant) which are indicated by dashed lines. The cardboard tabs 50, 51 or 52, 53 are separably connected to the longitudinal side walls 10, 11 via perforation lines 54, 55 or 56, 57. With a third variant 1''' the cardboard tabs 50, 51 or 52, 53 are absent and in the base wall 12 two wall sections 58, 59 which can be torn out are limited by perforation lines which are indicated by dashed lines. The wall sections 58, 59 which can be torn out are in the manner of centre sleeve punch-outs lozenge-shaped and are arranged on the score line 13.

According to FIG. 1 two "open basket carriers" 1' and two further ones 1" are adhesed in the adhesed, flat-lying condition into each transport box 60. This has longitudinal and end-face side walls 61 to 64 hinged to one another. The longitudinal side wall 61 on the end-face side has a connecting tab 65. Furthermore the longitudinal side walls 61 and 63 on the one longitudinal side has base flaps 66, 67 and on the oppositely lying side has lid flaps 72, 73. Furthermore they have middle fold lines 74, 75 which extend through the base flaps 70, 71 and through the lid flaps 72, 73.

According to FIG. 1*a* two pairs of multi-piece packagings 1', 1" are arranged such that each pair is aligned outwardly. The two multi-piece packagings 1', 1" of each pair may thus be set up by way of pressing together the end-face side walls 15, 17. According to FIG. 1*b* the multi-piece packagings 1', 1" with the longitudinal side walls 10, 11 are arranged on the inner sides of the longitudinal side walls 61, 63 and with the cardboard tabs 50, 51 or 52, 53 on the inside on the lid flaps 68, 69 of the transport box 60, wherein the cardboard tabs are adhesed to the lid flaps. In the arrangements according to FIGS. 1 and 2 the multi-piece packagings 1', 1" have the cardboard tabs 50, 51 and 52, 53 exclusively on the lower lying longitudinal side walls 10, 11 so that the cardboard tabs are actually (partly) covered. For illustration however all cardboard tabs 50 to 53 are illustrated. The longitudinal side walls 10, 11 of the multi-piece packagings 1', 1" are just half as long as the lateral side walls 61, 63 of the transport box so that the end-face side walls 15 and 17 of the multi-piece packagings 1'1" come to lie over bordering end-face side walls 62, 64 or the connecting tab 65 of the transport box 60.

According to FIG. 1*c* subsequently the transport box 60 by folding about the middle fold lines 74, 74 and adhesing the lateral side wall 64 to the connecting tab 65 is closed into a flat-lying envelope. Thus the packaging in stacks is delivered from the packing manufacturer to the packer.

The packer may set up the transport boxes by pressing together the middle fold lines 74, 75 until the end-face side walls 62, 64 are set up perpendicular to the longitudinal side walls 61, 63. With this the end-face side 62, 64 walls exert onto the inner bearing end-face side walls 15, 17 of the multi-piece packagings 1', 1" a pressure which by way of support of the multi-piece packagings 1', 1" on one another and their fastening on the longitudinal side walls 61, 63 is taken up and leads to a simultaneous right-angled folding open of the "open basket carrier" 1', 1". With this the base wall 12 of the multi-piece packagings 1', 1" closes automatically.

Thereafter the base flaps 70, 71 and 66, 67 of the transport box 60 is closed and adhesed to one another. In this configuration the transport box 60 is shown in FIG. 2*a*. By way of the adhesive fastening of the cardboard tabs 50 to 53 on the lid flaps 68, 69 between the closed bases of the four "open basket carriers" 1', 1" and the transport box 60 there is formed a hollow space.

Thus the transport box 60 is led to a filling installation which according to FIG. 2*b* from above 24 filled drinks bottles 80 are inserted through the opening 81 of the transport box 60. By way of the weight of the drinks bottles 80 the cardboard flaps 50 to 53 are torn off along their perforation lines 54 to 57. Then the four filled "open basket carriers" 1', 1" are pressed downwards up to the base of the transport box 60. The rest of the cardboard tabs 50 to 53 remain on the lid flaps 68, 69. This condition of the transport box is shown in FIG. 2*c*.

For completion of the packing process the lid flaps 72, 73 and 68, 69 of the transport box are closed and adhesed to one another. The finished transport box 60 corresponds in the manner and function largely to the known transport boxes with applied "open basket carriers". The deviating packing process is in particular recognizable on the box flaps 50 to 53. These may on opening the lid flaps 68, 69, 72, 73 be folded out of the opening 81 of the transport box 60 and do not prevent the removal of the multi-piece packagings 1', 1".

According to FIG. 6 with a second embodiment form of the transport box 60 in contrast to the one previously described has on the base flap 67 a connecting tab 76 on the base side. Furthermore with this embodiment form exclusively multi-piece packagings 1" with wall sections 58, 59 which can be torn out are applied.

According to FIG. 6*a* two pairs of multi-piece packagings 1'" are arranged such that the end-face side walls 15, 17 of the two multi-piece packagings 1'" of each pair are directed outwards. According to FIG. 6*b* the multi-piece packagings 1'" with the longitudinal side walls 10, 11 are placed on the inner sides of the longitudinal side walls 61, 63, wherein the lower edges of the longitudinal side walls 10, 11 are arranged on the lower edges of the longitudinal side walls 61, 63. The wall sections 58, 59 which may be torn out are arranged on the inner sides of the base flaps 66, 67 and are adhesed to these on their lower-lying halves. Also with this embodiment the end-face side walls 15 and 17 of the multi-piece packagings 1'" come to lie over bordering end-face side walls 62, 64 and the connection tab 65 of the transport box 60 respectively.

According to FIG. 6*c* subsequently the transport box 60 by way of folding about the middle fold lines 74, 75 and adhesing the end-face side wall 64 to the connecting tab 65 is closed to a flat-lying envelope. Furthermore the base flaps 66, 67 by way of folding over and adhesing the further connecting tab are connected to one another to a part-automatic base. Thus this packing is delivered in stacks from the packing manufacturer to the drinks manufacturer.

The drinks manufacturer may also set up these transport boxes 60 by pressing together the middle fold lines 74, 75, wherein the part-automatic base is tensioned from the base flaps 66, 67. With this the contained multi-piece packagings 1'" are set up in particular by introducing force from the end-face walls 62, 64 and the base flaps 66, 67 of the transport box 60.

Subsequently the base flaps 70, 71 are laid around and adhesed to the base flaps 66, 67. In this configuration the transport box 60 is shown in FIG. 7. The multi-piece packagings 1'" are already located in their final position on the base of the transport box 60.

In a filling installation then drinks bottles may be inserted through the opening 81 of the transport box 60 into the four contained multi-piece packagings 1'" and subsequently the lid flaps 72, 73 and 68, 69 may be closed.

After the opening of the lid flaps 68, 69, 72, 73 the removal packagings 1'" may be pulled out by way of a slight "jerk", wherein the wall sections 58, 59 tear out and remain in the transport box 60.

The third embodiment form has in place of the multi-piece packagings 1 a compartment unit 90 which firstly is explained by way of FIG. 9. It consists of three longitudinally-directed box strips 91 which at uniform distances comprise slots 62 which proceed from the lower edge of the strips and which extend roughly over half their height. Furthermore it has in an alternate arrangement transversely-directed cardboard strips 93, 94 which both at uniform distances have slots 95, 96 which extend from the upper edge of the strips and which likewise extend over roughly half their length. The longitudinally-directed cardboard strips 91 and the transversely-directed cardboard strips 93, 94 are inserted into one another in the known manner at their slots 92 and 95 and 96 respectively.

The transversely directed cardboard strips 94 have on both ends hinged fastening tabs 97.

The compartment unit may be flatly collapsed with the middle, longitudinally-directed cardboard strip 91' by folding together the two sections 93', 93" and 94', 94" of the transversely-directed cardboard strips 93, 94 about the connection axis defined by the slots 92 and 95, and 96.

FIG. 8*a* shows the compartment unit 90 in a flatly collapsed position, in which the middle cardboard strip 91' forms the one end and the two lateral cardboard strips 91, 91' the other end. The two fastening tabs 97 of the transversely-directed cardboard tabs 94 are arranged on the two outer sides of the flat-lying compartment unit 90. Thus the compartment unit 60 is fastened on the flat-lying blank of a transport box 60 which in all details corresponds to that of FIG. 1.

According to FIG. 8*b* for this the compartment unit 90 is positioned over the transport box 60 so that it with the end formed by the middle cardboard strip 91' occludes flush with the middle fold line 74, and with the fastening tabs 97 comes to lie over the longitudinal side wall 63. The fastening tabs 97 are adhesed to the longitudinal side wall 63. Then the transport box by folding about the middle fold lines 74, 75 is closed into a envelope, wherein the longitudinal side wall 61 is adhesed to the fastening tabs 97 on the other side of the compartment unit 90 and the connecting tab 65 to the end-face side wall 64. In this arrangement the transport box is shown in FIG. 8*c*. Thus in stacks in may be delivered from the packing manufacturer to the filler.

The filler may then set up the transport box 60 by pressing together the middle fold lines 74, 75, wherein the longitudinal side walls 61, 63 fold apart the sections 94', 94" of the transversely-directed cardboard strip 94 and by way of this set up the compartment unit 90. The setting up procedure may be supported by pressing the end-face side walls 62, 64 against the longitudinally-directed cardboard strips 91. Thereafter the base is closed by folding down and adhesing the base flaps 70, 71 and 66, 67. In this configuration the transport box is shown in FIG. 9.

It may likewise be filled by applying 24 bottles from above through the opening 81. Thereafter it is closed by closing and adhesing the lid flaps 72, 73 and 68, 69.

The bottles after opening the lid are individually withdrawn from the compartment unit 90.

What is claimed is:

1. A method for packing containers, in particular bottles, in transport boxes having base flaps, comprising the steps of releasably fastening flat-lying multi-piece packagings (1) having bases (12) to the inside of flat-lying transport boxes (60), the multi-piece packaging additionally having end-face side walls, transverse webs, and at least one longitudinal web, setting up the transport boxes (60) and the multi-piece packagings (1) contained therein by folding the multi-piece packagings end-face side walls (15, 17) and the multi-piece packagings transverse webs (33 to 36) from a longitudinal web (24, 25) and moving their longitudinal side walls (10, 11) out of contact with the longitudinal web (24, 25) whilst forming receivers open at the top, thereby automatically closing the bases (12) of the multi-piece packagings (1) and of the transport box (60) by folding the base flaps of the multi-piece packagings and transport box together along fold lines, and then pressing together a middle fold line (74, 75), and thereby folding open the base flaps (66,67) which are hinged on oppositely lying side walls (10,11) of the packagings and transport boxes, inserting containers (80) through openings (81) of the set-up transport boxes (60) into receivers of the multi-piece packagings (1) and closing the openings (81) of the transport boxes (60).

2. A method according to claim 1, in which the multi-piece packagings (1) on the inside are fastened onto flat, opened-out blanks (60) of the transport box, the transport boxes are closed into flat-lying envelopes (60), the envelopes (60) are set up and the containers (80) are inserted through openings (81) of the set-up envelopes (60).

3. A method according to claim 2, in which the transport boxes (60) include lateral walls (61 to 64) hinged to one another and which are folded about middle fold lines (74, 75) of two end-face side walls (62, 64) into flat-lying envelopes (60).

4. A method according to claim 1, in which the flat-lying transport boxes (60) with the multi-piece packagings (1) or compartment units (90) fastened thereto are stacked and individual transport boxes (60) with the multi-piece packagings (1) or compartment units (90) for setting up are withdrawn from the stack.

5. A method according to claim 1, in which the multi-piece packagings (1', 1") are releasably fastened by fastenings (50 to 53) in the closed transport boxes (60) such that by insertion of the containers (80) into openings (81) the fastenings (50 to 53) are released and the multi-piece packagings (1', 1") moved downward in the transport boxes.

6. A method according to claim 1, in which the multi-piece packagings (1', 1") are releasably fastened on lid flaps (68, 69) for closing the openings (81) of the transport boxes (60).

7. A method according to claim 1, in which the multi-piece packagings (1', 1") are fastened to the transport boxes (60) at the upper edges thereof by way of separable cardboard tabs (50 to 53).

8. A method according to claim 1, further including the step of providing the multi-piece packagings (1''') with perforated wall sections (58, 59) which can be tom off and which are releasably fastened on the transport boxes (60).

9. A method according to claim 8, in which the multi-piece packagings (1"), on wall sections (58, 59) of their base walls (12), these wall sections able to be torn off, are releasably fastened on base flaps (66, 67) of the transport boxes (60), wherein the wall sections (58, 59) are preferably arranged on middle axes (13) of the base walls (12).

10. A method according to claim 1, in which the multi-piece packagings (1) are fastened on the transport boxes (60) by an adhesive.

11. A method according to claim 1, in which walls (61 to 64) of the transport boxes (60) on setting up exert forces on inner bearing walls (11, 15, 17) of the multi-piece packagings (1) or end regions (97) of the compartment unit (90) by which means the multi-piece packagings are set up.

12. A method according to claim 1, in which base flaps are closed after setting up the transport box (60).

13. A method according to claim 1, in which lid flaps are closed after inserting the containers (80) into the transport boxes (60).

* * * * *